US010267144B2

(12) United States Patent
Hazel

(10) Patent No.: US 10,267,144 B2
(45) Date of Patent: Apr. 23, 2019

(54) DOWNHOLE SENSOR SYSTEM

(71) Applicant: WELLTEC A/S, Allerød (DK)

(72) Inventor: Paul Hazel, Aberdeen (GB)

(73) Assignee: Welltec A/S, Allerød (DK)

( * ) Notice: Subject to any disclaimer, the term of this patent is extended or adjusted under 35 U.S.C. 154(b) by 124 days.

(21) Appl. No.: 15/322,877

(22) PCT Filed: Jun. 29, 2015

(86) PCT No.: PCT/EP2015/064725
§ 371 (c)(1),
(2) Date: Dec. 29, 2016

(87) PCT Pub. No.: WO2016/001157
PCT Pub. Date: Jan. 7, 2016

(65) Prior Publication Data

US 2017/0138177 A1 May 18, 2017

(30) Foreign Application Priority Data

Jun. 30, 2014 (EP) ..... 14174990

(51) Int. Cl.
*E21B 47/06* (2012.01)
*E21B 47/01* (2012.01)
(Continued)

(52) U.S. Cl.
CPC ..... *E21B 47/06* (2013.01); *E21B 33/127* (2013.01); *E21B 34/06* (2013.01); *E21B 47/01* (2013.01); *E21B 47/12* (2013.01)

(58) Field of Classification Search
CPC ..... E21B 47/06; E21B 33/127; E21B 34/06; E21B 47/12
See application file for complete search history.

(56) References Cited

U.S. PATENT DOCUMENTS 6,443,228 B1 * 9/2002 Aronstam ..... E21B 47/01 166/250.11
2004/0129424 A1 * 7/2004 Hosie ..... E21B 21/08 166/332.8

(Continued)

OTHER PUBLICATIONS

International Search Report and Written Opinion of the ISA for PCT/EP2015/064725 dated Oct. 5, 2015, 10 pages.

(Continued)

*Primary Examiner* — Yong-Suk Ro
(74) *Attorney, Agent, or Firm* — Nixon & Vanderhye P.C.

(57) ABSTRACT

A downhole sensor system for measuring a pressure of a fluid downhole in a well, includes a well tubular structure having an inside and being arranged in a borehole with a wall and an annulus defined between the well tubular structure and the wall of the borehole, a sensor unit having a pressure unit sensor and being arranged in connection with the well tubular structure, the pressure unit sensor being adapted to measure a pressure of the fluid in the inside of the well tubular structure and/or in the annulus. The sensor unit further has a power supply and a communication module, a downhole tool with a power supply and a communication module for communication with the sensor unit. The downhole tool further comprises a pressure tool sensor adapted to measure a pressure of the fluid inside the well tubular structure substantially opposite the pressure unit sensor for comparison with the pressure measured by the pressure unit sensor.

15 Claims, 7 Drawing Sheets

(51) Int. Cl.

| | |
|---|---|
| ***E21B 33/127*** | (2006.01) |
| ***E21B 34/06*** | (2006.01) |
| ***E21B 47/12*** | (2012.01) |

(56) References Cited

U.S. PATENT DOCUMENTS

| | | | |
|---|---|---|---|
| 2005/0194184 | A1 | 9/2005 | Gleitman |
| 2005/0257611 | A1 | 11/2005 | Fogal et al. |
| 2012/0199400 | A1 | 8/2012 | Boulet et al. |

OTHER PUBLICATIONS

Extended Search Report for EP14174990.3 dated Oct. 16, 2014, 6 pages.

* cited by examiner

DOWNHOLE SENSOR SYSTEM

This application is the U.S. national phase of International Application No. PCT/EP2015/064725 filed 29 Jun. 2015 which designated the U.S. and claims priority to EP Patent Application No. 14174990.3 filed 30 Jun. 2014, the entire contents of each of which are hereby incorporated by reference.

FIELD OF THE INVENTION

The present invention relates to a downhole sensor system for measuring a pressure of a fluid downhole in a well. The present invention also relates to a measuring method, calibrating methods and an isolation testing method.

BACKGROUND ART

The distribution and content of hydrocarbon-containing fluid changes over time in a reservoir and many, more or less successful, attempts have been made to predict this development. The use of sensors measuring different fluid properties is one way of obtaining data for such prediction. The sensors are inserted into the formation along the borehole, and during measurements the sensors obtain vibrations from a seismic source located at the seabed or at surface. The vibrations change as the vibrations develop in the formation, and from the received vibrations in the sensors, the distribution and content of hydrocarbon-containing fluid in the reservoir can be analysed. Based on these predictions, the inflow valves, and thus the production zones, are adjusted so that the reservoir is emptied from hydrocarbons in a more optimal manner.

It is a problem that sensors drift over time due to the high temperatures and pressures, and the reliability of these sensor measurements is hence diminished to such an extent that accurate prediction is impossible.

SUMMARY OF THE INVENTION

It is an object of the present invention to wholly or partly overcome the above disadvantages and drawbacks of the prior art. More specifically, it is an object to provide an improved downhole sensor system capable of sensing the reservoir development so that the production is optimised more rapidly than in the known systems.

The above objects, together with numerous other objects, advantages and features, which will become evident from the below description, are accomplished by a solution in accordance with the present invention by a downhole sensor system for measuring a pressure of a fluid downhole in a well, comprising

- a well tubular structure having an inside and being arranged in a borehole with a wall and an annulus defined between the well tubular structure and the wall of the borehole,
- a sensor unit having a pressure unit sensor and being arranged in connection with the well tubular structure, the pressure unit sensor being adapted to measure a pressure of the fluid in the inside of the well tubular structure and/or in the annulus, the sensor unit further comprising a power supply and a communication module, and
- a downhole tool comprising a power supply and a communication module for communication with the sensor unit, wherein the downhole tool further comprises a pressure tool sensor adapted to measure a pressure of the fluid inside the well tubular structure substantially opposite the pressure unit sensor for comparison with the pressure measured by the pressure unit sensor.

The pressure unit sensor of the sensor unit may be adapted to measure the pressure of the fluid inside the well tubular structure, and the pressure tool sensor may measure the pressure of the fluid inside the well tubular structure opposite the pressure unit sensor so as to calibrate the pressure measurements of the pressure unit sensor by comparing the measured pressures of the pressure unit sensor with the measured pressure of the pressure tool sensor.

Further, the pressure unit sensor of the sensor unit may be in fluid communication with the fluid inside the well tubular structure and thus adapted to measure the pressure of the fluid in the fluid inside the well tubular structure.

Moreover, the sensor unit may comprise a second pressure unit sensor adapted to measure the pressure of the fluid in the annulus.

Also, the downhole tool may comprise a storage module.

Furthermore, the downhole tool may comprise a processor, a CPU or the like for processing the pressure measurements received from the sensor unit and/or the pressure tool sensor.

Additionally, the downhole sensor system as described above may further comprise an inflow valve arranged in the well tubular structure.

Further, the downhole tool may comprise a control device for adjusting a position of the inflow valve.

The sensor unit may be arranged in connection with the inflow valve for controlling the inflow of fluid.

In addition, the inflow valve may be open, the pressure unit sensor of the sensor unit may be adapted to measure the pressure of the fluid in the annulus, and the pressure tool sensor may measure the pressure of the fluid inside the well tubular structure opposite the pressure unit sensor after a pressure equilibrium between the annulus and the inside of the well tubular structure has been provided so as to calibrate the pressure measurements of the pressure unit sensor by comparing the measured pressures of the pressure unit sensor with the measured pressure of the pressure tool sensor.

Moreover, the downhole tool may comprise a positioning unit for arranging the pressure tool sensor substantially opposite the sensor unit.

The sensor unit may comprise a Radio Frequency Identification (RFID) tag.

Furthermore, the communication modules of the downhole tool and the sensor unit may communicate via an antenna, induction, electromagnetic radiation or telemetry.

Also, the sensor unit may comprise a transducer adapted to recharge the power supply of the sensor unit.

Additionally, the recharging may be by means of radio frequency, acoustics, or electromagnetic radiation.

Further, the sensor unit may comprise a three-port valve having a first port in fluid communication with the annulus, a second port in fluid communication with the inside of the well tubular structure, and a third port fluidly connected with the pressure unit sensor so as to bring the pressure unit sensor in fluid communication with either the annulus or the inside in order to measure an annulus pressure of a fluid in the annulus and an inside pressure of a fluid in the inside, respectively.

The three-port valve may comprise a switching element switching between a first position fluidly connecting the first port with the third port and a second position fluidly connecting the second port with the third port.

Said three-port valve may further comprise a control sensor device connected with the switching element for controlling the position of the three-port valve.

Also, the control device may be adapted to control the switching element from the first position to the second position, or vice versa, in order that the annulus pressure and the inside pressure can be measured substantially simultaneously.

Furthermore, the pressure unit sensor of the sensor unit may be in fluid communication with the annulus and thus adapted to measure the pressure of the fluid in the annulus.

The downhole sensor system as described above may further comprise a first annular barrier and a second annular barrier, each annular barrier comprising:

a tubular part adapted to be mounted as part of the well tubular structure, the tubular part having an outer face, an expandable metal sleeve surrounding the tubular part and having an inner sleeve face facing the tubular part and an outer sleeve face facing the wall of the borehole, each end of the expandable sleeve being connected with the tubular part, and an annular space between the inner sleeve face of the expandable sleeve and the tubular part, the first annular barrier and the second annular barrier being adapted to isolate a production zone when expanded, and the inflow valve being arranged opposite the production zone and having an open and a closed position for controlling the inflow of fluid from the production zone into the well tubular structure.

An opening may be arranged in the tubular part opposite the annular space for providing fluid communication between the inside of the well tubular structure and the annular space, so that pressurised fluid can be let into the annular space to expand the expandable metal sleeve.

Moreover, a valve may be arranged in the opening.

Said valve may be a check valve.

Furthermore, the annular space may comprise a compound adapted to expand the annular space.

Also, the compound may comprise at least one thermally decomposable compound adapted to generate gas or supercritical fluid upon decomposition.

Further, the compound may comprise nitrogen.

In addition, the compound may be selected from a group consisting of: ammonium dichromate, ammonium nitrate, ammonium nitrite, barium azide, sodium nitrate, or a combination thereof.

Moreover, the compound may be present in the form of a powder, a powder dispersed in a liquid or a powder dissolved in a liquid.

One or both ends of the expandable sleeve may be connected with the tubular part by means of connection parts.

Sealing elements may be arranged between the connection parts or the end of the expandable sleeve and the tubular part.

The downhole sensor system as described above may further comprise a plurality of first and second annular barriers for isolating a plurality of production zones.

Also, the inflow valve may be arranged between the first and the second annular barriers opposite the production zone.

Further, the sensor unit may be arranged in connection with an annular barrier.

In addition, the sensor unit and/or the downhole tool may comprise a temperature sensor.

Furthermore, the downhole tool may comprise a transducer.

Moreover, the downhole tool may comprise a surface read-out module.

Additionally, the downhole tool may comprise an activation means adapted to remotely activate the sensor unit.

Also, the downhole tool may comprise a driving unit, such as a downhole tractor.

The power supply of the sensor unit may be replaceable.

Further, the downhole tool may comprise a second power supply adapted to replace the power supply of the sensor unit in the well tubular structure.

In addition, the downhole tool may comprise a second sensor unit for replacing the sensor unit in the well tubular structure.

Moreover, the downhole tool may comprise an operating tool, the operating tool being a drilling bit for drilling a bore in the well tubular structure, so that the second sensor unit can be inserted in the bore in the well tubular structure.

The system as described above may further comprise a plurality of sensor units.

Also, the sensor unit may comprise an additional sensor adapted to measure at least one fluid property, the fluid property being e.g. capacitance, resistivity, flow rate, water content or temperature.

Said additional sensor may be a flow rate sensor, a capacitance sensor, a resistivity sensor, an acoustic sensor or a temperature sensor.

Furthermore, the downhole sensor system as described above may comprise a first annular barrier, a second annular barrier and a third annular barrier, each annular barrier comprising:

a tubular part adapted to be mounted as part of the well tubular structure, the tubular part having an outer face, an expandable metal sleeve surrounding the tubular part and having an inner sleeve face facing the tubular part and an outer sleeve face facing the wall of the borehole, each end of the expandable sleeve being connected with the tubular part, and an annular space between the inner sleeve face of the expandable sleeve and the tubular part, the first annular barrier being adapted to provide zone isolation between a first annulus and a second annulus when expanded, a first inflow valve having an open and a closed position and being arranged in the well tubular structure opposite the second annulus, and the sensor unit which is a first sensor unit being arranged at the first inflow valve, the second annular barrier being adapted to provide zone isolation between the second annulus and a third annulus when expanded, a second inflow valve with an open and a closed position being arranged in the well tubular structure opposite the third annulus, and a second sensor unit being arranged at the second inflow valve, the third annular barrier being adapted to provide zone isolation between the third annulus and a fourth annulus when expanded, and wherein the downhole tool is adapted to be arranged opposite the first sensor unit for communicating with the first sensor unit and for measuring the pressure of the fluid inside the well tubular structure substantially opposite the first sensor unit, and subsequently to be arranged opposite the second sensor unit for communicating with the second sensor unit and for measuring the pressure of the fluid inside the well tubular structure substantially opposite the second sensor unit, so that the pressures of the sensor unit and the second sensor unit can be compared with the pressures measured by the pressure tool sensor.

The communication module may be adapted to communicate data received from the sensor unit and/or from the pressure tool sensor to a central storing device having a database, so that the data can be stored in the database, whereby the data can be assessed and used to follow the development of the well in the different annuluses and zones, and the data can be compared with the actual production of hydrocarbon-containing fluid from the well, so that the data can be used for optimising the production of the same well, or other wells.

The present invention also relates to a measuring method for measuring a pressure of a fluid downhole in a well by means of the downhole sensor system according to any of the preceding claims, comprising the steps of:

measuring a pressure of the fluid in the inside of the well tubular structure and/or in the annulus by the sensor unit, positioning the downhole tool so that the pressure tool sensor is substantially opposite the sensor unit, communicating the measured pressure from the sensor unit to the downhole tool, measuring a pressure of the fluid inside of the well tubular structure substantially opposite the sensor unit by the pressure tool sensor, and comparing the measured pressure of the sensor unit with the measured pressure of the pressure tool sensor.

Furthermore, the present invention relates to a calibrating method for calibrating a measurement of a pressure of a fluid inside a well tubular structure, the calibrating method being performed by means of the downhole sensor system as described above and comprising the steps of:

calibrating the pressure tool sensor, introducing the downhole tool in the well tubular structure, positioning the downhole tool substantially opposite the sensor unit, measuring a pressure of the fluid in the inside of the well tubular structure by the pressure unit sensor, measuring the pressure of the fluid inside the well tubular structure opposite the sensor unit by the pressure tool sensor, and calibrating the pressure measurements of the pressure unit sensor by comparing the measured pressures of the pressure unit sensor with the measured pressure of the pressure tool sensor.

The present invention further relates to a calibrating method for calibrating a measurement of a pressure of a fluid in the annulus outside a well tubular structure having an inflow valve with an open and a closed position, the calibrating method being performed by means of the downhole sensor system as described above and comprising the steps of:

calibrating the pressure tool sensor, introducing the downhole tool in the well tubular structure, ensuring an open position of the inflow valve, stopping the production of hydrocarbon-containing fluid so that a pressure equilibrium between the annulus and the inside of the well tubular structure is provided, positioning the downhole tool substantially opposite the sensor unit, measuring a pressure of the fluid in the annulus by the pressure unit sensor, measuring the pressure of the fluid inside the well tubular structure opposite the sensor unit by the pressure tool sensor, and calibrating the pressure measurements of the pressure unit sensor by comparing the measured pressures of the pressure unit sensor with the measured pressure of the pressure tool sensor.

Moreover, the present invention relates to a calibrating method for calibrating a measurement of a pressure of a fluid in the annulus outside a well tubular structure, and a measurement of a pressure of a fluid inside the well tubular structure, the well tubular structure having an inflow valve with an open and a closed position, the calibrating method being performed by means of the downhole sensor system as described above and comprising the steps of:

calibrating the pressure tool sensor, introducing the downhole tool in the well tubular structure, ensuring an open position of the inflow valve, stopping the production of hydrocarbon-containing fluid so that a pressure equilibrium between the annulus and the inside of the well tubular structure is provided, measuring a pressure of the fluid in the annulus by the pressure unit sensor of the sensor unit, measuring the pressure of the fluid inside the well tubular structure by the second pressure unit sensor of the sensor unit, positioning the downhole tool substantially opposite the sensor unit, measuring the pressure of the fluid inside the well tubular structure opposite the sensor unit by the pressure tool sensor, and calibrating the pressure measurements of the pressure unit sensor and the second pressure unit sensor by comparing the measured pressures of the pressure unit sensors with the measured pressure of the pressure tool sensor.

Finally, the present invention relates to an isolation testing method for testing an annular barrier providing zone isolation between a first annulus and a second annulus, wherein a first inflow valve may be arranged opposite the first annulus and a second inflow valve may be arranged opposite the second annulus, the isolation testing method comprising the steps of:

performing calibration of the pressure measurements by applying the calibration method as described above, ensuring a closed position of the second inflow valve, ensuring an open position of the first inflow valve, creating a pressure difference between the first annulus and the second annulus, measuring a pressure of the fluid in the first annulus, measuring a pressure of the fluid in the second annulus, and performing an isolation check of the annular barrier by comparing the pressure of the fluid in the first annulus with the pressure of the fluid in the second annulus.

In the isolation testing method as described above, a second annular barrier may be arranged between the second annulus and a third annulus, and a third inflow valve may be arranged opposite the third annulus, the testing method further comprising the steps of:

ensuring an open position of the third valve before creating the pressure difference, wherein the step of creating a pressure difference further comprises creating a pressure difference between the second annulus and the third annulus, measuring a pressure of the fluid in the third annulus, and performing an isolation check of the second annular barrier by comparing the pressure of the fluid in the second annulus with the pressure of the fluid in the third annulus.

The step of creating a pressure difference may be performed by increasing a gas lift in an upper part of the well tubular structure above the annular barriers.

Also, the step of creating a pressure difference may be performed by pumping fluid into the well tubular structure.

Further, the step of creating a pressure difference may be performed by pumping fluid towards the top of the well tubular structure.

Moreover, the present invention relates to a calibrating method for calibrating a measurement of a pressure of a fluid inside a well tubular structure, the calibrating method being performed by means of the downhole sensor system as described above and comprising the steps of:

calibrating the pressure tool sensor, introducing the downhole tool in the well tubular structure, positioning the downhole tool substantially opposite the sensor unit, measuring the pressure of the fluid inside the well tubular structure opposite the sensor unit by the pressure tool sensor, and calibrating the pressure measurements of the pressure unit sensor by comparing the measured pressures of the pressure unit sensor with the measured pressure of the pressure tool sensor.

The calibrating method as described above may further comprise the step of measuring a pressure of the fluid in the inside of the well tubular structure by the pressure unit sensor, Furthermore, the calibrating method as described above may comprise the steps of:

ensuring an open position of the inflow valve, stopping the production of hydrocarbon-containing fluid so that a pressure equilibrium between the annulus and the inside of the well tubular structure is provided, and measuring a pressure of the fluid in the annulus by the pressure unit sensor of the sensor unit.

The calibrating method as described above may further comprise the steps of:

ensuring an open position of the inflow valve, stopping the production of hydrocarbon-containing fluid so that a pressure equilibrium between the annulus and the inside of the well tubular structure is provided, and measuring a pressure of the fluid in the annulus by the pressure unit sensor.

BRIEF DESCRIPTION OF THE DRAWINGS

The invention and its many advantages will be described in more detail below with reference to the accompanying schematic drawings, which for the purpose of illustration show some non-limiting embodiments and in which.

All the figures are highly schematic and not necessarily to scale, and they show only those parts which are necessary in order to elucidate the invention, other parts being omitted or merely suggested.

DETAILED DESCRIPTION OF THE INVENTION

Figure 1:
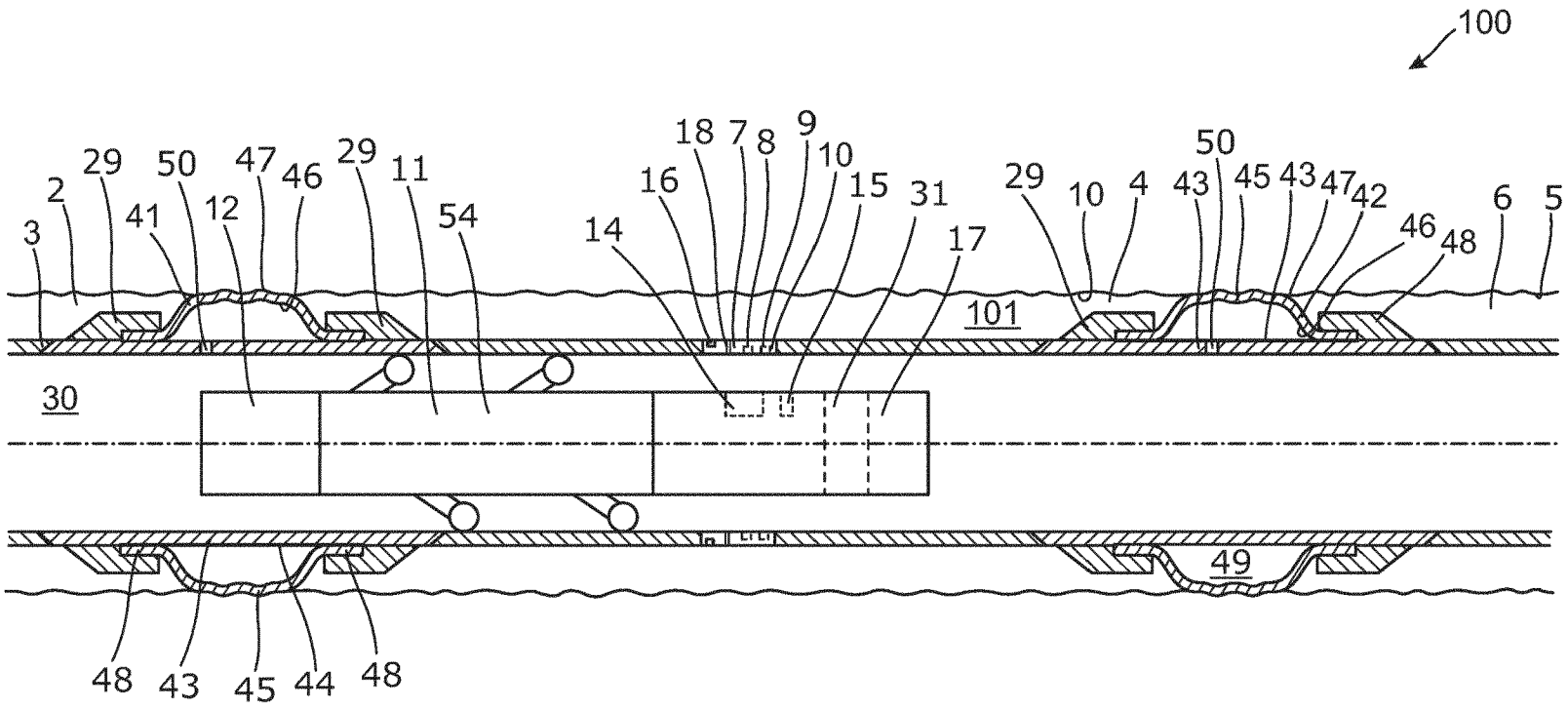
FIG. 1 shows a partly cross-sectional view of a downhole sensor system.

FIG. 1 shows a downhole sensor system 100 for measuring a pressure of a fluid downhole in a well 2. The downhole sensor system 100 comprises a well tubular structure 3 in the form of a metal casing having an inside 30 and being arranged in a borehole 4, so that an annulus 6 is defined between the well tubular structure 3 and a wall 5 of the borehole. The downhole sensor system 100 further comprises a sensor unit 7 having a pressure unit sensor 8 and the sensor unit 7 is arranged at least partly in the well tubular structure 3. The pressure unit sensor 8 is adapted to measure a pressure of the fluid in the inside of the well tubular structure 3 and/or in the annulus 6. The sensor unit 7 further comprises a power supply 9 for powering the sensor 8 and a communication module 10 for transferring the measured data from the sensor 8 to a downhole tool 11. The downhole tool 11 comprises a power supply 12, such as a battery or a wireline (shown in FIG. 3). The downhole tool 11 also comprises a communication module 14 for communication with the sensor unit 7.

The downhole tool 11 further comprises a pressure tool sensor 15 adapted to measure a pressure of the fluid inside the well tubular structure 3 substantially opposite the pressure unit sensor 8 for comparison with the pressure measured by the pressure unit sensor. When a sensor has been located in a well for some time, the sensor may drift so that it becomes less accurate when measuring the pressure, and by measuring the pressure by means of the pressure tool sensor 15 of the downhole tool 11 under the same conditions as the pressure unit sensor 8, the pressure measurements of the sensor unit 7 can thus be calibrated and the sensor pressure measurements can thus be adjusted to be more accurate in a processor in the tool 11 or in a database at surface. The data from the pressure unit sensor 8 of the sensor unit 7 is collected at regular intervals when a tool is submerged in the well, e.g. when performing another operation in the well. At this time, the tool 11 can easily measure the pressure opposite every pressure unit sensor 8 it passes and collect data therefrom. The data can then be uploaded into a database and the pressure unit sensor 8 can be corrected from the pressure measurements performed by the pressure tool sensor 15 of the downhole tool 11 which has been calibrated shortly before entering the well and which is thus more accurate than sensors exposed to the harsh environment downhole.

If the pressure unit sensor 8, which is a first pressure unit sensor, is adapted to measure the pressure of the fluid inside the well tubular structure 3, the sensor unit comprises 7 a second pressure unit sensor 16 adapted to measure the pressure of the fluid in the annulus 6. The measurements performed by the second pressure unit sensor 16 can thus be calibrated when the tool downloads data from the first and the second pressure unit sensors 8, 16. The first and the second pressure unit sensors have been subjected to almost the same environment, and by assuming that the first and the second pressure unit sensors 8, 16 have drifted equally, so that their measurements are offset to an equal extent, the pressure measurements of the first pressure unit sensor 8 can likewise be corrected. In FIG. 1, the first and the second pressure unit sensors 8, 16 are arranged in connection with an inflow valve 18 for controlling the inflow of fluid, the inflow valve 18 being arranged in the well tubular structure 3. By measuring the pressure when the flow (production) has been stopped and the inflow valve 18 is open and after a pressure equilibrium between the annulus 6 and the inside of the well tubular structure 3 has been provided, the first and the second pressure unit sensors 8, 16 should measure the same pressure. When the measurement data is loaded by the tool 11 later on, the measurements performed over the last period of time by the first pressure unit sensor 8 can be more accurately corrected by comparing the measured pressures of the pressure unit sensor 8 with the measured pressure of the pressure tool sensor 15. For this purpose, the downhole tool 11 comprises a storage module 17.

When loading all these data from one or more pressure unit sensors, the downhole tool 11 may comprise a processor 31, a CPU, or the like for processing the pressure measurements received from the sensor unit 7 and/or from the pressure tool sensor 15 and only transmitting a first data set uphole and subsequently merely transmitting data when measurements vary from the first data set. In this way, the amount of data to be sent uphole can be substantially minimised, and the operator at surface is informed before the tool is drawn from the well, and the operator can thus send instructions to the tool to measure some other properties or to perform a certain operation, such as to adjust a position of the inflow valve by a control device 32 (shown in FIG. 4) before the tool is drawn out of the well.

In FIG. 1, the system 100 further comprises a first annular barrier 41 and a second annular barrier 42. Each annular barrier comprises a tubular part 43 adapted to be mounted as part of the well tubular structure 3. An expandable metal sleeve 45 surrounds an outer face 44 of the tubular part, where an inner sleeve face 46 of the sleeve faces the tubular part and an outer sleeve face 47 faces the wall of the borehole. Each end 48 of the expandable metal sleeve is connected with the tubular part defining an annular space 49 between the inner sleeve face of the expandable metal sleeve and the tubular part. When the expandable metal sleeve is expanded, the first annular barrier and the second annular barrier isolate a production zone 101, and the inflow valve 18 is arranged opposite the production zone 101 and the inflow valve 18 has an open position and a closed position for controlling the inflow of fluid from the production zone into the well tubular structure 3.

As can be seen in FIG. 1, both ends of the expandable metal sleeve are connected with the tubular part 43 by means of connection parts 29. Sealing elements may be arranged between the connection parts 29 or between the end of the expandable metal sleeve and the tubular part 43. Furthermore, an opening 50 is arranged in the tubular part of each annular barrier opposite the annular space 49 for providing fluid communication between the inside of the well tubular structure 3 and the annular space 49, so that pressurised fluid can be let into the annular space to expand the expandable metal sleeve 45. A valve, such as a check valve, may be arranged in the opening.

Figure 2:
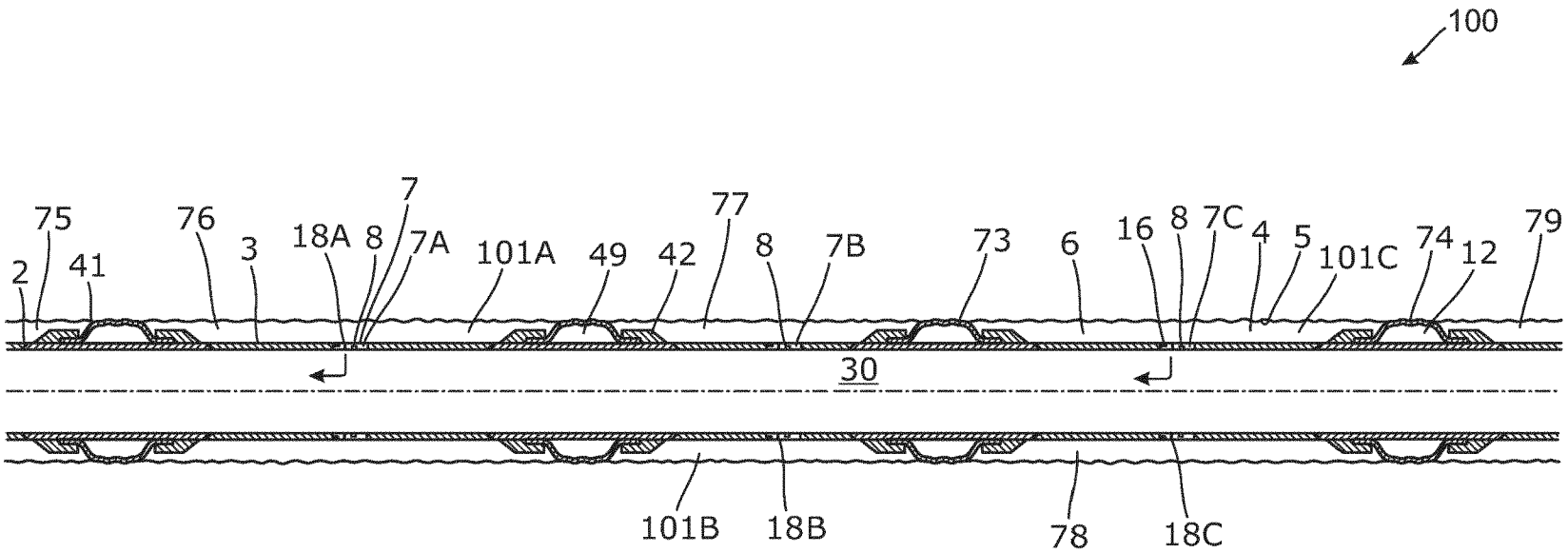
FIG. 2 shows part of the system during an isolation test.

In FIG. 2, a compound is arranged in the annular space 49 and is adapted to expand the annular space and thus the expandable metal sleeve, when the compound is subjected to heat or a second compound is mixed therewith. The compound may comprise at least one thermally decomposable compound, e.g. nitrogen, adapted to generate gas or supercritical fluid upon decomposition and thus expand the expandable metal sleeve.

The compound may be selected from a group consisting of: ammonium dichromate, ammonium nitrate, ammonium nitrite, barium azide, sodium nitrate, or a combination thereof. And the compound may be present in the form of a powder, a powder dispersed in a liquid or a powder dissolved in a liquid.

In FIG. 2, the downhole sensor system 100 comprises a first annular barrier 41, a second annular barrier 42, a third annular barrier 73 and a fourth annular barrier 74. The first annular barrier 41 provides zone isolation between a first annulus 75 and a second annulus 76, the second annular barrier provides zone isolation between the second annulus and a third annulus 77, the third annular barrier provides zone isolation between the third annulus and a fourth annulus 78, and the fourth annular barrier provides zone isolation between the fourth annulus and a fifth annulus 79. A first inflow valve 18A is arranged in the well tubular structure opposite the second annulus, and the sensor unit 7 which is a first sensor unit 7A is arranged at the first inflow valve. A second inflow valve 18B is arranged in the well tubular structure 3 opposite the third annulus, and a second sensor unit 7B is arranged at the second inflow valve. A third inflow valve 18C is arranged in the well tubular structure opposite the fourth annulus, and a third sensor unit 7C is arranged at the third inflow valve 18C.

The downhole sensor system 100 may be used to test if an annular barrier provides zone isolation between two annuluses or production zones, 101A, 101B, 101C. In FIG. 2, the second production zone 101B is tested by closing the second inflow valve 18B, and by opening the first inflow valve 18A and the third inflow valve 18C, and then a pressure difference between the second annulus and the first annulus and a pressure difference between the second annulus and the third annulus is created, and a further difference may be created e.g. by increasing the gas lift in an upper part of the well tubular structure above the annular barriers. While the pressure difference is provided, a pressure of the fluid in the first annulus, the second annulus and the third annulus is measured, and by comparing the pressure of the fluid in the first and the third annulus with the pressure of the fluid in the second annulus, an isolation check of the second production zone is performed.

The step of creating a pressure difference may also be performed by pumping fluid into the well tubular structure to increase the pressure inside the well tubular structure, or by pumping fluid out of the well towards the top of the well tubular structure to decrease the pressure inside the well tubular structure.

Figure 3:
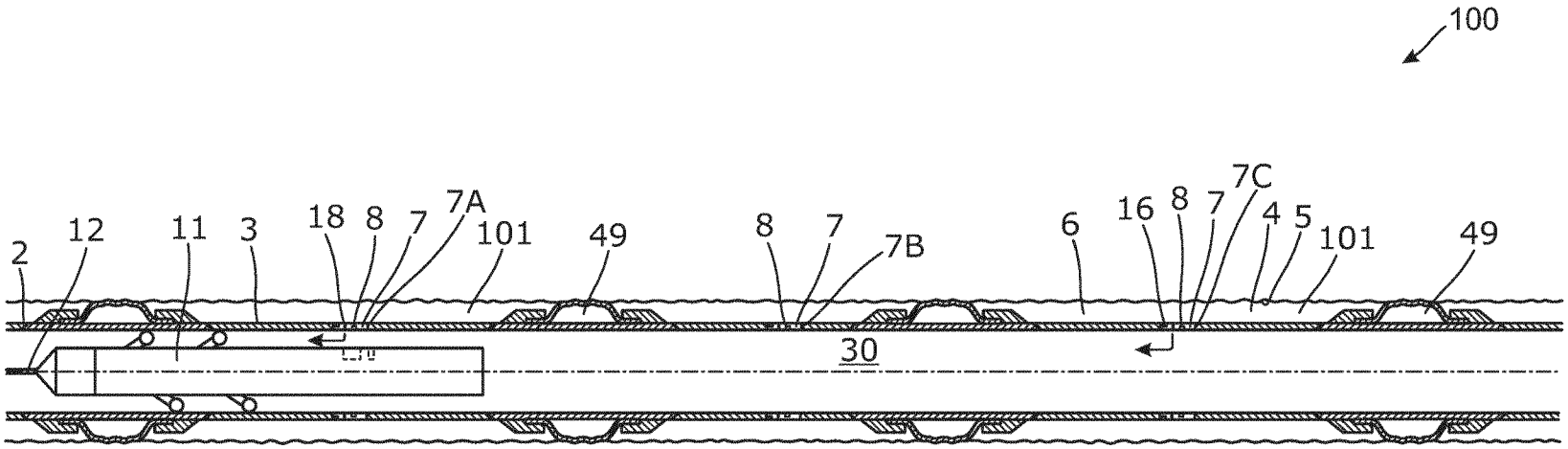
FIG. 3 shows a partly cross-sectional view of another downhole sensor system.
Figure 7:
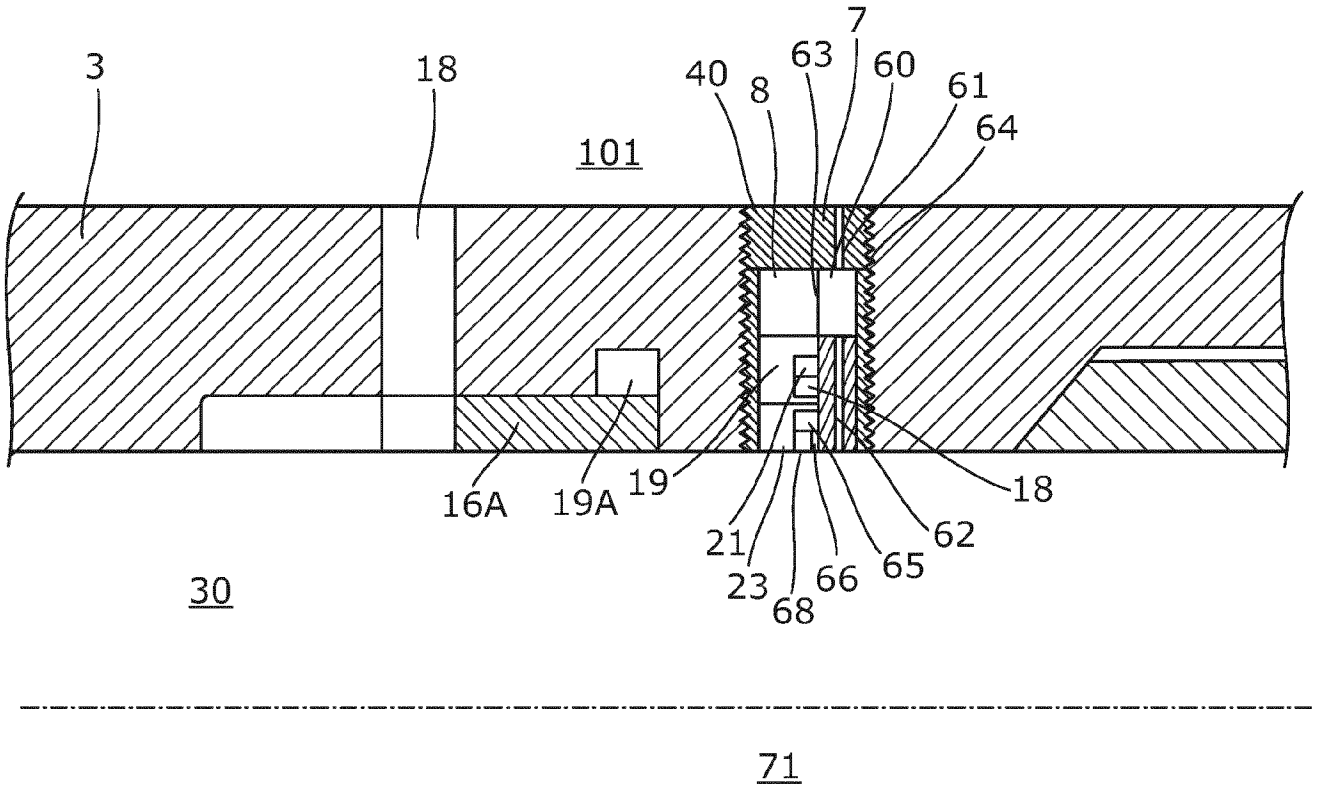
FIG. 7 shows a cross-sectional view of a sensor unit inserted in a well tubular structure in connection with an inflow valve.

While performing the isolation check, the downhole tool 11 may be arranged opposite the first sensor unit 7A for communication with the first sensor unit, as shown in FIG. 3, and for measuring the pressure of the fluid inside the well tubular structure 3 substantially opposite the first sensor unit. Subsequently, the tool may be arranged opposite the second sensor unit 7B for communication with the second sensor unit and for measuring the pressure of the fluid inside the well tubular structure 3 substantially opposite the second sensor unit, so that the pressures of the first sensor unit and the second sensor unit can be compared with the pressures measured by the pressure tool sensor. By having sensor units, as shown in FIG. 7, capable of measuring both inside and outside the well tubular structure by means of one sensor in each unit, the measurements of the sensors can be calibrated by measuring the pressure inside the well tubular structure substantially simultaneously with the sensors of the sensor units measuring the pressure both inside and outside the well tubular structure. In this way, the pressure measurements of the tool can be compared to those of the sensor units and the measurements can thus be corrected accordingly.

Figure 4:
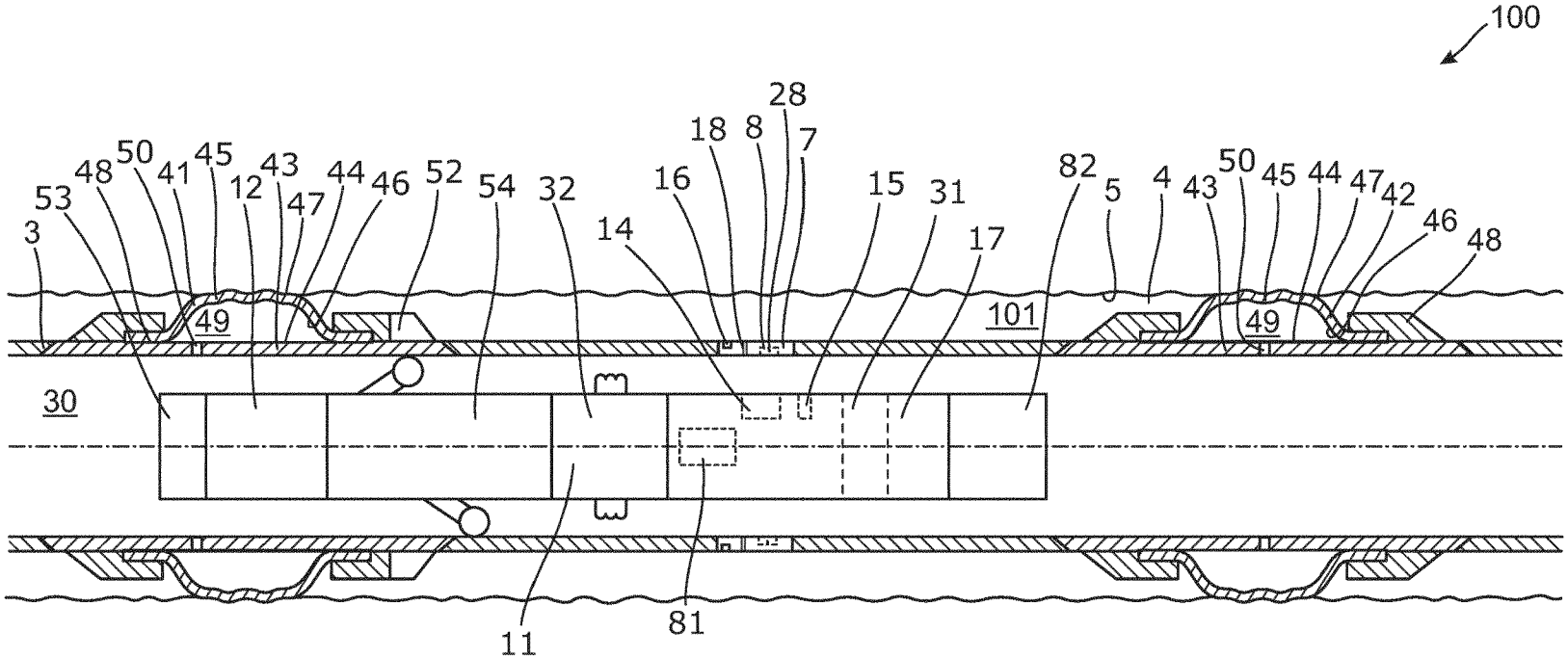
FIG. 4 shows a partly cross-sectional view of yet another downhole sensor system.

As shown in FIG. 4, the downhole tool comprises a driving unit 54 in order to be self-propelling in the well, and the communication modules of the downhole tool and the sensor unit communicate via an antenna (no. 66 shown in FIG. 7), induction, electromagnetic radiation or telemetry in order to transmit data from the sensor unit to the tool and/or to recharge the sensor unit. In this way, a sensor unit having a battery time of e.g. six month can become operable again and measure the pressure for another six months. Furthermore, the tool is able to activate the sensor unit after six months' time in order to perform a pressure measurement, so that the measured pressure in the six months can be calibrated/corrected even though the sensor unit itself cannot be recharged.

In order to be recharged, the sensor unit comprises a transducer 28, as shown in FIG. 4, adapted for recharging the power supply of the sensor unit, e.g. through an antenna 66 (shown in FIG. 7). The recharging may be by means of radio frequency, acoustics or electromagnetic radiation. In order to operate at an exact position downhole, the downhole tool comprises a positioning unit 81 for arranging the pressure tool sensor substantially opposite the sensor unit 7 or for arranging an operational tool/control device 32, such as keys, opposite a sliding sleeve of an inflow valve, to be engaged and adjusted.

As shown in FIG. 4, the tool may comprise further sensors for measuring other fluid properties. In FIG. 4, the tool comprises a capacitance sensor 82 in front of the tool for determining the fluid content. As shown in FIG. 3, a plurality of sensors may be arranged in the well tubular structure. The sensors may be adapted to measure fluid properties such as capacitance, resistivity, flow rate, water content or temperature. Thus, the additional sensor may be a flow rate sensor, a capacitance sensor, a resistivity sensor, an acoustic sensor or a temperature sensor.

In FIG. 4, the system comprises a further sensor unit 52 which is arranged in connection with an annular barrier for measuring the pressure in the annular space 49 in comparison to the pressure of the annulus on either side of the annular barrier in order to equalise any pressure difference by opening the adjacent inflow valve.

Figure 5:
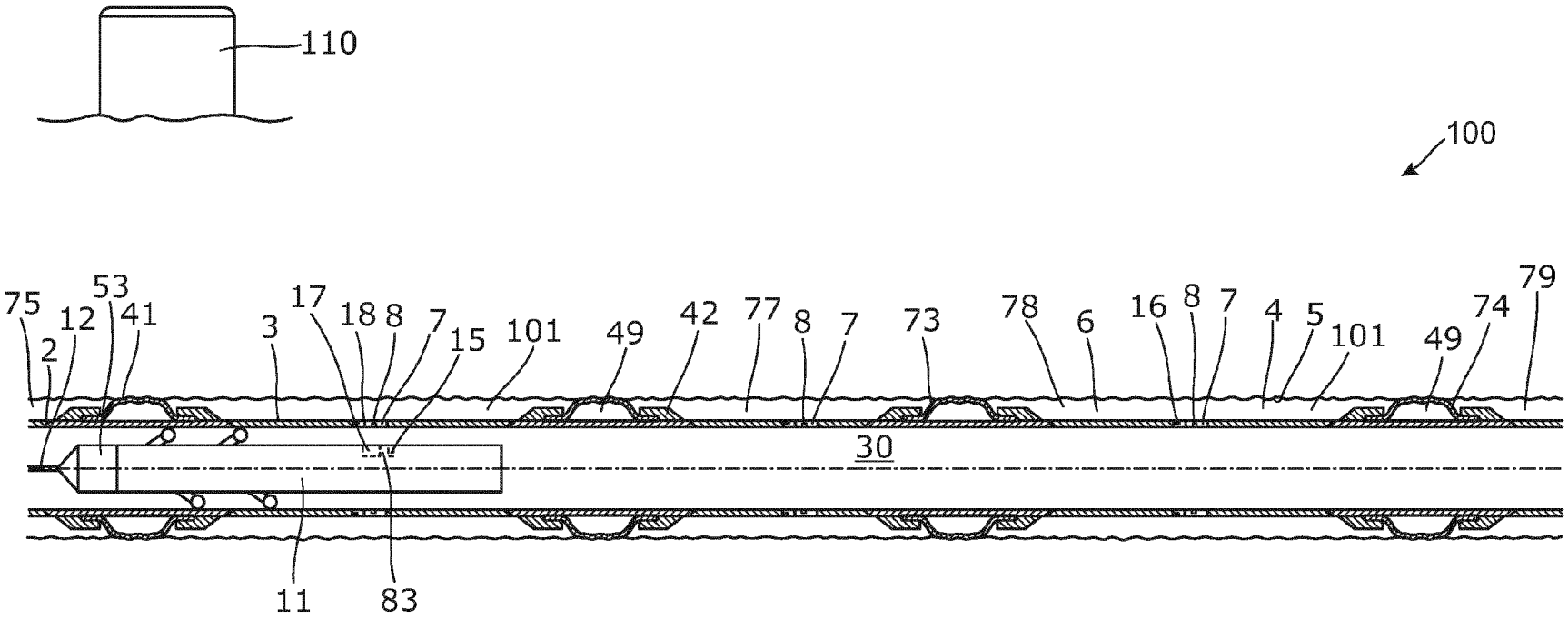
FIG. 5 shows a partly cross-sectional view of yet another downhole sensor system.

In FIG. 5, the downhole tool 11 comprises a surface read-out module 53, which is located in the end of the tool being closest to the surface for transmitting data to surface. The data is transmitted to a database 110 at surface through the wireline 12 which also functions as the power supply. Furthermore, the downhole tool comprises an activation means 83 in the form of a transducer for remotely activating and powering the sensor unit 7. Each sensor unit may comprise a Radio Frequency Identification (RFID) tag 68 (shown in FIG. 7). The communication module of the tool is adapted to communicate data received from the sensor unit and/or from the pressure tool sensor to a central storing device having a database 110, so that the data can be stored in the database, whereby the data can be assessed and used to follow the development of the well in the different annuluses and production zones, and the data can be compared with the actual production of hydrocarbon-containing fluid from the well. These data can also be used for optimising the production of the same well or other wells by analysing the data recently received and by comparing such data with other kinds of reservoir or production data received from other sensors, tools, or even other wells. The data in the database can also be used to get a more general assessment of the reservoir if the data is used together with the seismic data, the data from other sensors in the formation, the borehole, the casing or in the tool or even in other wells. The other sensors may measure the capacitance, the temperature, the water content etc., and all these data can be stored in the database and used for a more accurate prediction of the future development of the reservoir.

Figure 6:
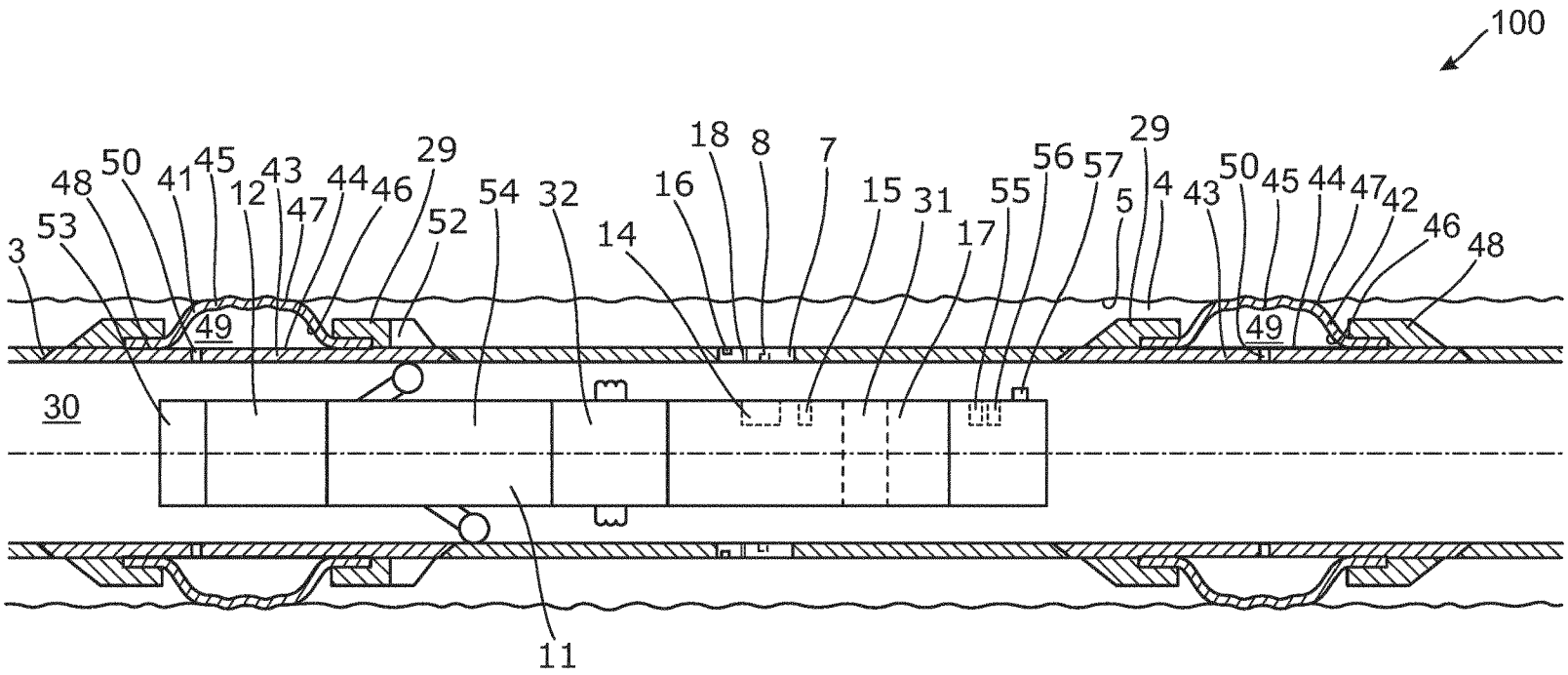
FIG. 6 shows a partly cross-sectional view of yet another downhole sensor system.

In the event that the sensor unit 7 in the well tubular structure 3 does not function properly if functioning at all, the downhole tool as shown in FIG. 6 comprises a second power supply 55 adapted to replace the power supply of the sensor unit in the well tubular structure. If the sensor unit does not function, the downhole tool comprises a second sensor unit 56 for replacing the sensor unit in the well tubular structure. In order to replace the sensor unit, if the existing sensor unit cannot be released from the well tubular structure, the downhole tool comprises an operating tool 57, the operating tool being a drilling bit for drilling a bore in the well tubular structure, so that the second sensor unit can be inserted in a new bore in the well tubular structure drilled by the drilling bit.

In FIG. 7, the sensor unit 7 comprises a three-port valve 60 having a first port in fluid communication with the annulus/production zone 101, a second port in fluid communication with the inside 30 of the well tubular structure, and a third port fluidly connected with the pressure unit sensor 8 so as to bring the pressure unit sensor in fluid communication with either the annulus or the inside for measuring an annulus pressure of a fluid in the annulus and an inside pressure of a fluid in the inside, respectively. The three-port valve 60 may comprise a switching element (not shown) switching between a first position fluidly connecting the first port with the third port and a second position fluidly connecting the second port with the third port. Thus, the sensor unit may further comprise a control sensor device (not shown) connected with the switching element for controlling the position of the three-port valve. The control device is adapted to control the switching element from the first position to the second position, or vice versa, in order that the annulus pressure and the inside pressure can be measured substantially simultaneously.

In FIG. 7, the sensor unit 7 is an insert which may be inserted in an opening 64 in the well tubular structure 3 adjacent the inflow valve 18. The sensor unit 7 comprises a three-port valve 60 and fluid channels providing fluid communication between the inside of the well tubular structure and the three-port valve 60, or fluid communication between the annulus and the three-port valve 60 depending on the position of the valve. The control unit 19 controls the closing member 16A through a second control unit 19A. In FIG. 7, the sensor unit comprises a Radio Frequency Identification (RFID) tag 68.

By measuring both upstream and downstream of the closing member 16A as shown in FIG. 7, the result of the choking can quickly be determined and the inflow valve 18 thus further adjusted if required. The control unit 19 comprises a processor 21 for this purpose and for comparing the measurement with a preselected property range, so that the inflow valve is adjusted if the measured property is outside the range. The inflow valve may comprise several sensors measuring different properties of the fluid, so that one measured property can be confirmed by another measurement, e.g. if the water content increases, the capacity measurement is capable of detecting such change, and if the temperature is furthermore measured to drop, the increasing water content is thus confirmed. Likewise, if the gas content increases, which can be measured by the capacitance measurement, this can be confirmed by a pressure measurement.

The pressure of the fluid in a well downhole is measured inside of the well tubular structure and/or in the annulus by the sensor unit continuously or at certain intervals. Subsequently, the downhole tool is positioned so that the pressure tool sensor is substantially opposite the sensor unit, and so that the measured pressure from the sensor unit is communicated to the downhole tool. Simultaneously, shortly before or after, a pressure of the fluid inside of the well tubular structure is measured substantially opposite the sensor unit by means of the pressure tool sensor, and the measured pressure of the sensor unit is then compared with the measured pressure of the pressure tool sensor in order to calibrate the measured pressure data from the pressure unit sensor. Before the tool is submerged into the well, the pressure tool sensor is calibrated.

In the downhole sensor system comprising an inflow valve in connection with one sensor unit, which only measures the pressure outside the well tubular structure, the calibrating method is performed by first calibrating the pressure tool sensor and introducing the downhole tool in the well tubular structure. It is then ensured that the inflow valve is in its open position, and if not, the inflow valve is opened. The production of hydrocarbon-containing fluid is stopped so that a pressure equilibrium between the annulus and the inside of the well tubular structure can be provided. The downhole tool is positioned substantially opposite the sensor unit for measuring a pressure of the fluid in the annulus by the pressure unit sensor and almost simultaneously measuring the pressure of the fluid inside the well tubular structure opposite the pressure tool sensor, and as the flow has been stopped, the pressure of the fluid in the annulus and the pressure of the fluid inside the well tubular structure opposite the pressure tool sensor should be the same. Then the pressure measurements of the pressure unit sensor are calibrated by comparing the measured pressure of the pressure unit sensor with the measured pressure of the pressure tool sensor.

In the downhole sensor system comprising an inflow valve in connection with one sensor unit, which measures the pressure both inside and outside the well tubular structure, the calibrating method is performed by first calibrating the pressure tool sensor and introducing the downhole tool in the well tubular structure. The tool is then positioned substantially opposite the sensor unit, and the pressure unit sensor and the pressure tool sensor both measure the pressure inside the well tubular structure. The measurements of the pressure unit sensor can then be calibrated by comparing the pressure measurements performed simultaneously by the tool and the sensor unit, since the pressure unit sensor may be assumed to have drifted equally when measuring the inside pressure or the annulus pressure.

By fluid or well fluid is meant any kind of fluid that may be present in oil or gas wells downhole, such as natural gas, oil, oil mud, crude oil, water, etc. By gas is meant any kind of gas composition present in a well, completion, or open hole, and by oil is meant any kind of oil composition, such as crude oil, an oil-containing fluid, etc. Gas, oil, and water fluids may thus all comprise other elements or substances than gas, oil, and/or water, respectively.

By a well tubular structure or casing is meant any kind of pipe, casing, tubing, tubular, liner, string etc. used downhole in relation to oil or natural gas production.

In the event that the tool is not submergible all the way into the casing, a downhole tractor 54 can be used to push the tool all the way into position in the well. The downhole tractor may have projectable arms having wheels, wherein the wheels contact the inner surface of the casing for propelling the tractor and the tool forward in the casing. A downhole tractor is any kind of driving tool capable of pushing or pulling tools in a well downhole, such as a Well Tractor®.

Although the invention has been described in the above in connection with preferred embodiments of the invention, it will be evident for a person skilled in the art that several modifications are conceivable without departing from the invention as defined by the following claims.

The invention claimed is:

1. A downhole sensor system for measuring a pressure of a fluid downhole in a well, comprising a well tubular structure having an inside and being arranged in a borehole with a wall and an annulus defined between the well tubular structure and the wall of the borehole, a sensor unit having a pressure unit sensor and being arranged in connection with the well tubular structure, the pressure unit sensor being adapted to measure a pressure of the fluid in the inside of at least one of the well tubular structure and in the annulus, the sensor unit further comprising a power supply and a communication module, and a downhole tool comprising a power supply and a communication module for communication with the sensor unit, wherein the downhole tool further comprises a pressure tool sensor adapted to measure a pressure of the fluid inside the well tubular structure substantially opposite the pressure unit sensor for comparison with the pressure measured by the pressure unit sensor.

2. The downhole sensor system according to claim 1, wherein the pressure unit sensor of the sensor unit is adapted to measure the pressure of the fluid inside the well tubular structure, and the pressure tool sensor measures the pressure of the fluid inside the well tubular structure opposite the pressure unit sensor so as to calibrate the pressure measurements of the pressure unit sensor by comparing the measured pressure of the pressure unit sensor with the measured pressure of the pressure tool sensor.

3. The downhole sensor system according to claim 1, wherein the sensor unit comprises a second pressure unit sensor adapted to measure the pressure of the fluid in the annulus.

4. The downhole sensor system according to claim 1, wherein the downhole tool comprises a storage module.

5. The downhole sensor system according to claim 1, further comprising an inflow valve arranged in the well tubular structure.

6. The downhole sensor system according to claim 5, wherein the inflow valve is open, the pressure unit sensor of the sensor unit is adapted to measure the pressure of the fluid in the annulus, and the pressure tool sensor measures the pressure of the fluid inside the well tubular structure opposite the pressure unit sensor after a pressure equilibrium between the annulus and the inside of the well tubular structure has been provided so as to calibrate the pressure measurements of the pressure unit sensor by comparing the measured pressures of the pressure unit sensor with the measured pressure of the pressure tool sensor.

7. The downhole sensor system according to claim 1, wherein the system further comprises a first annular barrier and a second annular barrier, each annular barrier comprising:

a tubular part adapted to be mounted as part of the well tubular structure, the tubular part having an outer face, an expandable metal sleeve surrounding the tubular part and having an inner sleeve face facing the tubular part and an outer sleeve face facing the wall of the borehole, each end of the expandable metal sleeve being connected with the tubular part, and an annular space between the inner sleeve face of the expandable metal sleeve and the tubular part, the first annular barrier and the second annular barrier being adapted to isolate a production zone when expanded, and the inflow valve being arranged opposite the production zone and having an open and a closed position for controlling the inflow of fluid from the production zone into the well tubular structure.

8. The downhole sensor system according to claim 1, wherein the system comprises a first annular barrier, a second annular barrier and a third annular barrier, each annular barrier comprising:

a tubular part adapted to be mounted as part of the well tubular structure, the tubular part having an outer face, an expandable metal sleeve surrounding the tubular part and having an inner sleeve face facing the tubular part and an outer sleeve face facing the wall of the borehole, each end of the expandable metal sleeve being connected with the tubular part, and an annular space between the inner sleeve face of the expandable metal sleeve and the tubular part, the first annular barrier being adapted to provide zone isolation between a first annulus and a second annulus when expanded, a first inflow valve having an open and a closed position and being arranged in the well tubular structure opposite the second annulus, and the sensor unit which is a first sensor unit being arranged at the first inflow valve, the second annular barrier being adapted to provide zone isolation between the second annulus and a third annulus when expanded, a second inflow valve with an open and a closed position being arranged in the well tubular structure opposite the third annulus, and a second sensor unit being arranged at the second inflow valve, the third annular barrier being adapted to provide zone isolation between the third annulus and a fourth annulus when expanded, and wherein the downhole tool is adapted to be arranged opposite the first sensor unit for communicating with the first sensor unit and for measuring the pressure of the fluid inside the well tubular structure substantially opposite the first sensor unit, and subsequently to be arranged opposite the second sensor unit for communicating with the second sensor unit and for measuring the pressure of the fluid inside the well tubular structure substantially opposite the second sensor unit, so that the pressures of the sensor unit and the second sensor unit can be compared with the pressures measured by the pressure tool sensor.

9. The downhole sensor system according to claim 1, wherein the communication module is adapted to communicate data received from at least one of the sensor unit and the pressure tool sensor to a central storing device having a database, so that the data can be stored in the database, whereby the data can be assessed and used to follow the development of the well in the different annuluses and zones, and the data can be compared with the actual production of hydrocarbon-containing fluid from the well, so that the data can be used for optimising the production of the same well, or other wells.

10. A measuring method for measuring a pressure of a fluid downhole in a well by means of the downhole sensor system according to claim 1, comprising:

measuring a pressure of the fluid in the inside of at least one of the well tubular structure and the annulus by the sensor unit, positioning the downhole tool so that the pressure tool sensor is substantially opposite the sensor unit, communicating the measured pressure from the sensor unit to the downhole tool, measuring a pressure of the fluid inside of the well tubular structure substantially opposite the sensor unit by the pressure tool sensor, and comparing the measured pressure of the sensor unit with the measured pressure of the pressure tool sensor.

11. A calibrating method for calibrating a measurement of a pressure of a fluid inside a well tubular structure, the calibrating method being performed by means of the downhole sensor system according claim 1 and comprising:

calibrating the pressure tool sensor, introducing the downhole tool in the well tubular structure, positioning the downhole tool substantially opposite the sensor unit, measuring a pressure of the fluid in the inside of the well tubular structure by the pressure unit sensor, measuring the pressure of the fluid inside the well tubular structure opposite the sensor unit by the pressure tool sensor, and calibrating the pressure measurements of the pressure unit sensor by comparing the measured pressures of the pressure unit sensor with the measured pressure of the pressure tool sensor.

12. A calibrating method for calibrating a measurement of a pressure of a fluid in the annulus outside a well tubular structure having an inflow valve with an open and a closed position, the calibrating method being performed by means of the downhole sensor system according to claim 1 and comprising:

calibrating the pressure tool sensor, introducing the downhole tool in the well tubular structure, ensuring an open position of the inflow valve, stopping the production of hydrocarbon-containing fluid so that a pressure equilibrium between the annulus and the inside of the well tubular structure is provided, positioning the downhole tool substantially opposite the sensor unit, measuring a pressure of the fluid in the annulus by the pressure unit sensor, measuring the pressure of the fluid inside the well tubular structure opposite the sensor unit by the pressure tool sensor, and calibrating the pressure measurements of the pressure unit sensor by comparing the measured pressures of the pressure unit sensor with the measured pressure of the pressure tool sensor.

13. A calibrating method for calibrating a measurement of a pressure of a fluid in the annulus outside a well tubular structure, and a measurement of a pressure of a fluid inside the well tubular structure, the well tubular structure having an inflow valve with an open and a closed position, the calibrating method being performed by means of the downhole sensor system according to claim 1 and comprising:

calibrating the pressure tool sensor, introducing the downhole tool in the well tubular structure, ensuring an open position of the inflow valve, stopping the production of hydrocarbon-containing fluid so that a pressure equilibrium between the annulus and the inside of the well tubular structure is provided, measuring a pressure of the fluid in the annulus by the pressure unit sensor of the sensor unit, measuring the pressure of the fluid inside the well tubular structure by the second pressure unit sensor of the sensor unit, positioning the downhole tool substantially opposite the sensor unit, measuring the pressure of the fluid inside the well tubular structure opposite the sensor unit by means of the pressure tool sensor, and calibrating the pressure measurements of the pressure unit sensor and the second pressure unit sensor by comparing the measured pressures of the pressure unit sensors with the measured pressure of the pressure tool sensor.

14. An isolation testing method for testing an annular barrier providing zone isolation between a first annulus and a second annulus, wherein a first inflow valve is arranged opposite the first annulus and a second inflow valve is arranged opposite the second annulus, the isolation testing method comprising:

performing calibration of the pressure measurements by applying the calibration method according to claim 11, ensuring a closed position of the second inflow valve, ensuring an open position of the first inflow valve, creating a pressure difference between the first annulus and the second annulus, measuring a pressure of the fluid in the first annulus, measuring a pressure of the fluid in the second annulus, and performing an isolation check of the annular barrier by comparing the pressure of the fluid in the first annulus with the pressure of the fluid in the second annulus.

15. The isolation testing method according to claim 14, wherein a second annular barrier is arranged between the second annulus and a third annulus, and a third inflow valve is arranged opposite the third annulus, the testing method further comprising:

ensuring an open position of the third valve before creating the pressure difference, wherein the step of creating a pressure difference further comprises creating a pressure difference between the second annulus and the third annulus, measuring a pressure of the fluid in the third annulus, and performing an isolation check of the second annular barrier by comparing the pressure of the fluid in the second annulus with the pressure of the fluid in the third annulus.

* * * * *